US008730059B2

(12) United States Patent
Davis et al.

(10) Patent No.: US 8,730,059 B2
(45) Date of Patent: May 20, 2014

(54) OPTIMIZING TRAFFIC SPEEDS TO MINIMIZE TRAFFIC PULSES IN AN INTELLIGENT TRAFFIC SYSTEM

(75) Inventors: William S. Davis, Longmont, CO (US); Robert C. McGinley, Olympia, WA (US)

(73) Assignee: International Business Machines Corporation, Armonk, NY (US)

( * ) Notice: Subject to any disclaimer, the term of this patent is extended or adjusted under 35 U.S.C. 154(b) by 644 days.

(21) Appl. No.: 12/624,538

(22) Filed: Nov. 24, 2009

(65) Prior Publication Data

US 2011/0121993 A1 May 26, 2011

(51) Int. Cl.

| | |
|---|---|
| ***G08G 1/08*** | (2006.01) |
| ***G08G 1/07*** | (2006.01) |
| ***G06G 7/76*** | (2006.01) |

(52) U.S. Cl.

USPC ..... 340/911; 340/917; 340/915; 340/907; 340/916; 701/117; 701/118; 701/119; 701/120; 701/414; 701/423

(58) Field of Classification Search

USPC ..... 340/907–932.1

See application file for complete search history.

(56) References Cited

U.S. PATENT DOCUMENTS

| | | | | |
|---|---|---|---|---|
| 2,284,633 | A | 6/1942 | Bosch | |
| 2,922,981 | A * | 1/1960 | Anderson | 340/907 |
| 3,252,132 | A * | 5/1966 | Bolton | 340/909 |
| 3,660,812 | A * | 5/1972 | Inose et al. | 340/911 |
| 3,778,764 | A * | 12/1973 | Kamb | 340/907 |
| 5,257,194 | A * | 10/1993 | Sakita | 701/117 |
| 5,278,554 | A * | 1/1994 | Marton | 340/910 |
| 5,646,853 | A * | 7/1997 | Takahashi et al. | 455/456.5 |
| 6,150,961 | A | 11/2000 | Alewine et al. | |
| 6,166,658 | A * | 12/2000 | Testa | 701/93 |
| 6,167,331 | A * | 12/2000 | Matsumoto et al. | 701/23 |
| 6,292,745 | B1 * | 9/2001 | Robare et al. | 701/409 |
| 6,418,371 | B1 * | 7/2002 | Arnold | 701/117 |
| 6,825,778 | B2 | 11/2004 | Bergan et al. | |
| 7,860,639 | B2 * | 12/2010 | Yang | 701/117 |
| 7,890,123 | B2 * | 2/2011 | Granito et al. | 455/456.1 |
| 7,890,126 | B2 * | 2/2011 | Benco et al. | 455/466 |

(Continued)

OTHER PUBLICATIONS

"A Variable Speed Limit System Deployed at a Work Zone on I-96 in Lansing, Michigan Contributed to a Decrease in Travel Times and an Increase in Average Speeds"; RITA; ITS; Michigan DOT and Michigan State University; Sep. 2003; Lansing, Michigan, USA, 2 pgs. www.itsbenefits.its.dot.gov/its/benecost.nsf/Print/F3678455A0AF327785257260006 . . . .

(Continued)

*Primary Examiner* — Steven Lim
*Assistant Examiner* — Muhammad Adnan
(74) *Attorney, Agent, or Firm* — Nicholas L. Cadmus; John Pivnichny

(57) ABSTRACT

According to a method of vehicular traffic management, a computer system receives, from devices distributed in a plurality of roadway segments of a physical roadway system, real-time traffic information individually describing vehicular traffic in each the plurality of roadway segments. The computer system determines from the real-time traffic information an advised speed for a particular roadway segment among the plurality of roadway segments. The computer system transmits, via a communication network, a speed advisory command specifying the advised speed to a device in the particular roadway segment for presentation.

24 Claims, 5 Drawing Sheets

(56) References Cited

U.S. PATENT DOCUMENTS

| | | | | |
|---|---|---|---|---|
| 7,907,063 | B2 * | 3/2011 | Simon | 340/905 |
| 2002/0008637 | A1 * | 1/2002 | Lemelson et al. | 340/907 |
| 2002/0062207 | A1 * | 5/2002 | Faghri | 703/8 |
| 2003/0225668 | A1 * | 12/2003 | Goto et al. | 705/37 |
| 2004/0056778 | A1 * | 3/2004 | Hilliard | 340/933 |
| 2004/0068393 | A1 * | 4/2004 | Lawrence | 702/183 |
| 2006/0122846 | A1 * | 6/2006 | Burr et al. | 705/1 |
| 2010/0070253 | A1 * | 3/2010 | Hirata et al. | 703/8 |
| 2010/0207787 | A1 * | 8/2010 | Catten et al. | 340/905 |

OTHER PUBLICATIONS

"Speed Limit"; Wikipedia, the free encyclopedia; Sep. 22, 2009; http://en.wikipedia.org/wiki/Speed_limit, 13 pgs.

* cited by examiner

OPTIMIZING TRAFFIC SPEEDS TO MINIMIZE TRAFFIC PULSES IN AN INTELLIGENT TRAFFIC SYSTEM

BACKGROUND OF THE INVENTION

1. Technical Field

The present invention relates in general to traffic systems and, in particular, to optimization of traffic speeds in an intelligent traffic system.

2. Description of the Related Art

A vehicle roadway can only support a certain number of traveling vehicles (expressed, for example, in vehicles per unit of roadway length or vehicles passing a fixed point on the roadway per unit of time) before the roadway becomes congested. As congestion increases, spacing between vehicles decreases, leading the drivers of at least some vehicles to reduce the travel speed of their vehicles to below the current average speed for their lane of traffic. In many cases, this reduction in travel speed causes a cascading effect in which even a slight reduction in vehicle travel speed at one point on the roadway causes approaching traffic traveling in the same direction to slow dramatically or come to a complete stop. This cascading effect of speed reduction is referred to as a "traffic pulse" or "traffic wave."

Traffic pulses lead to inefficiencies, such as excessive braking and acceleration, which increase vehicle wear and reduce vehicle fuel economy. Traffic pulses also undesirably increase the average travel times for vehicles on a roadway.

SUMMARY OF THE INVENTION

In some embodiments, a computer system receives, from devices distributed in a plurality of roadway segments of a physical roadway system, real-time traffic information individually describing vehicular traffic in each the plurality of roadway segments. The computer system determines from the real-time traffic information an advised speed for a particular roadway segment among the plurality of roadway segments. The computer system transmits, via a communication network, a speed advisory command specifying the advised speed to a device in the particular roadway segment for presentation.

BRIEF DESCRIPTION OF THE DRAWINGS

The present invention, as well as a preferred mode of use, will best be understood by reference to the following detailed description of one or more illustrative embodiments when read in conjunction with the accompanying drawings, wherein.

DETAILED DESCRIPTION OF ILLUSTRATIVE EMBODIMENT

Figures 1A, 1B:
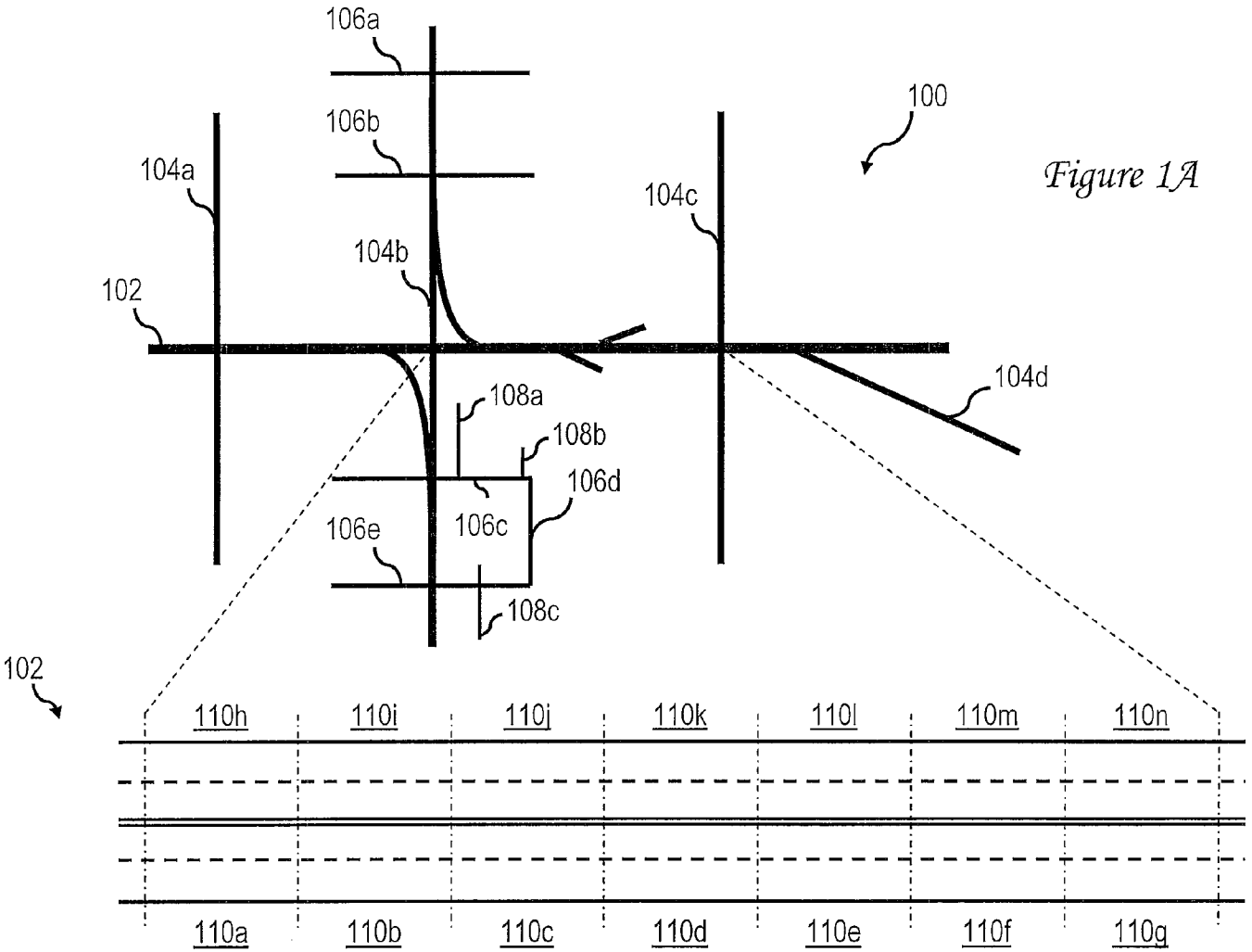
FIG. 1A is a plan view of an exemplary physical roadway system.
FIG. 1B is a more detailed plan view of a portion of a roadway comprising multiple roadway segments.

With reference now to the figures and in particular with reference to FIG. 1A, there is illustrated a simplified plan view of selected roadways in an exemplary physical roadway system 100 for carrying vehicular traffic. The illustrated portion of physical roadway system 100 includes a highway or motorway 102, which generally has the highest permitted vehicle speeds and the highest traffic volume. Highway 102 intersects with a number of principal arterial streets 104*a*, 104*b*, 104*c* and 104*d*, which generally have lower permitted vehicle speeds and lower expected traffic volumes. Principal arterial streets 104 (and possibly highway 102) are in turn intersected and/or fed by secondary arterial streets, such as exemplary secondary arterial streets 106*a*-106*e*, which have still lower permitted vehicles speeds and expected traffic volumes. Physical roadway system 100 further includes additional local or city streets, such as exemplary local streets 108*a*-108*c*, which may intersect any of roadways 102, 104 or 106. Local streets 108 have the lowest permitted vehicle speeds and expected traffic volumes. It will be appreciated that the simplified view of physical roadway system 100 given in FIG. 1A is not intended to exhaustively represent all roadways in physical roadway system 100 and accordingly omits or simplifies the illustration of some roadways within physical roadway system 100 to avoid obscuring the basic structure thereof.

Referring now to FIG. 1B, there is illustrated is a more detailed plan view of a portion of highway 102 of FIG. 1A. The illustrated portion of highway 102 comprises multiple roadway segments, including seven segments, labeled 110*a*-110*g*, carrying vehicle traffic in one direction of vehicle travel and seven segments, labeled 110*h*-110*n*, carrying vehicle traffic in an opposing direction of vehicle travel. Although illustrated as having equal lengths, it should be appreciated that segments 110 can be of differing lengths and that boundaries of segments 110 for opposing directions of vehicle traffic need not align.

Figure 2:
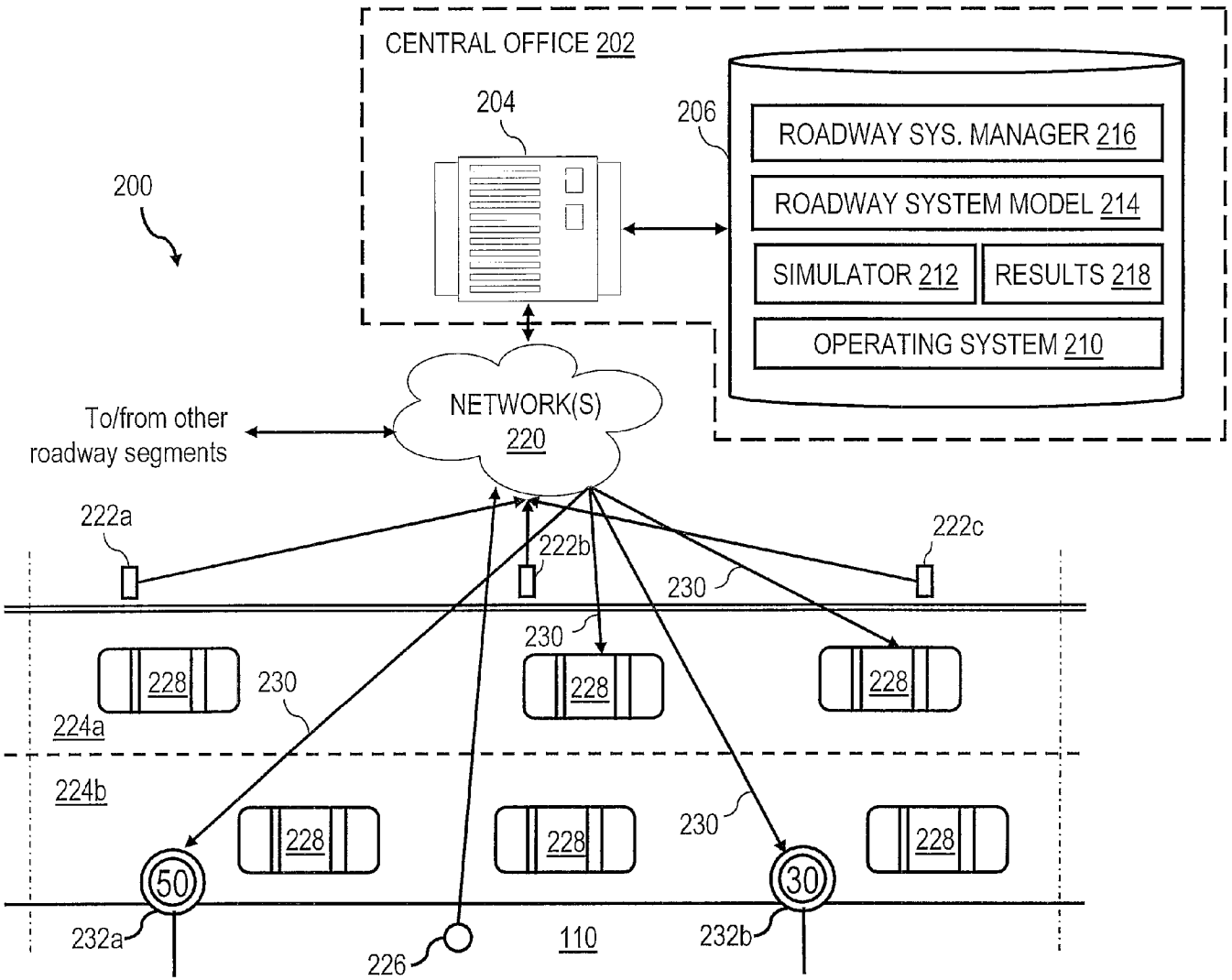
FIG. 2 depicts an intelligent roadway management system in accordance with one embodiment.

With reference now to FIG. 2, there is illustrated an exemplary intelligent roadway management system (IRMS) 200 in accordance with one embodiment. IRMS 200 includes a central office 202, which includes a hardware processing unit 204, such as an IBM Power Systems server or IBM System z mainframe computer, and data storage 206. Data storage 206 stores program code, including software and data, that when processed by hardware processing unit 204 implements intelligent roadway management. The program code within data storage 206 includes an operating system 210, such as AIX (Advanced Interactive eXecutive), Linux or z/OS, that manages the resources and operation of hardware processing unit 204 and provides services to middleware and application software. The program code in data storage 206 also includes a roadway system model 214 representing a physical roadway system (e.g., physical roadway system 100 of FIG. 1A) and a simulator 212 that, when executed by hardware processing unit 204, simulates traffic flows in the physical roadway system represented by roadway system model 214 under a variety of simulated operating conditions. The program code in data storage 206 further includes a roadway system manager 216 that manages vehicle traffic in physical roadway system 100 based, for example, on real-time traffic and weather information in multiple segments of physical roadway system 100, historical traffic flows in physical roadway system 100, and/or simulation results 218 obtained from the simulation of roadway system model 214.

IRMS 200 preferably further includes at least one traffic monitor 222 for each segment of roadway under management. For example, FIG. 2 depicts a generic segment 110 of roadway system 100, which has two lanes 224*a*, 224*b* in which vehicles 228 may travel. The traffic within segment 110 is monitored by three traffic monitors 222*a*, 222*b* and 222*c*, which are devices that preferably individually or collectively detect multiple traffic factors regarding vehicle traffic in segment 110. The traffic factors can include, for example, vehicle count over various time periods (optionally including per lane counts), individual and average vehicle speeds over various time periods, and presence and counts of various vehicle types (e.g., motorcycles, passenger vehicles, light trucks, commercial trucks, public transportation vehicles, emergency vehicles, school buses, etc.). Traffic monitors 222 may include or be communicatively coupled to components embedded within traffic lanes 224*a*, 224*b*, such as commercially available pressure or electromagnetic traffic sensors for detecting vehicle counts, vehicle speed and/or vehicle type. Traffic monitors 222 may alternatively or additionally employ other commercially available detection technologies, such as optical, laser, radar or RFID detection, in order to detect vehicle counts, vehicle speeds or vehicle types. In at least some embodiments, one or more vehicle computers (see, e.g., vehicle computer 502 of FIG. 5) may directly report, either autonomously or in response to a query, traffic factors regarding the associated vehicle to central office 202 utilizing wireless communication over network(s) 220, as discussed further below.

Traffic monitors 222 are coupled via one or more wired or wireless communication networks 220 (which may include one or more public circuit-switched or packet-switched networks) to central office 202 to provide substantially real-time traffic information to roadway system manager 216. As noted above, the substantially real-time traffic information can include, for example, vehicle counts over various time periods, individual and average vehicle speeds over various time periods, and presence and counts of various vehicle types (e.g., motorcycles, passenger vehicles, light trucks, commercial trucks, public transportation vehicles, emergency vehicles, school buses, etc.).

Communication network(s) 220 further couple roadway system manager 216 to a weather information source 226, which provides fine-grain weather information regarding the real-time weather conditions in segment 110, such as, temperature, precipitation presence and amount, wind speed, wind direction, barometric pressure, etc. Weather information sources 226 may be located within or adjacent one or more segment 110 (e.g., mounted to roadside poles), or alternatively or additionally, may be located remotely from segment 110 while still providing fine-grain weather conditions for individual segments 110. Thus, in some embodiments, one or more weather information sources 226 will be component(s) of IRMS 200, while in other embodiments weather information source 226 will not be a component of IRMS 200 and may instead be a publicly-accessible weather information source, such as National Oceanic and Atmospheric Administration (NOAA) or a web-based commercial weather information provider (e.g., the Weather Channel).

IRMS 200 may optionally include at least one variable speed advisory sign, which displays one or more vehicle speeds in response to receipt from roadway system manager 216 of a speed advisory command 230 specifying one or more advised vehicle speeds. For example, in the exemplary embodiment, segment 110 of FIG. 2 contains two variable speed advisory signs 232*a* and 232*b*. Each advised speed displayed by a variable speed advisory signs 232 may represent a maximum speed limit, a minimum speed limit, a maximum or minimum speed limit for some but not all vehicle (or driver) types, or merely a recommended (but not legally mandated) vehicle speed. In one preferred embodiment, the advised speed is an optimal speed of vehicle travel based at least in part upon traffic conditions in one or more preceding ("upstream") or succeeding ("downstream") segments of the same or intersecting roadway(s). As described further below and as shown in FIG. 2, roadway system manager 216 may further provide a speed advisory command 230 directly to one or more vehicles 228 traveling in the various segments 110 of roadway system 100 via network(s) 220. Communication of speed advisory commands 230 can be encrypted for security.

Figure 3:
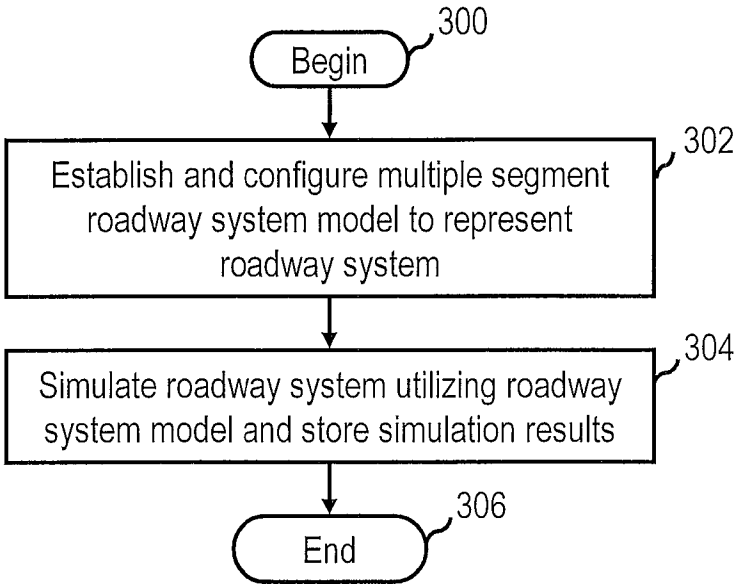
FIG. 3 is a high level logical flowchart of an exemplary process of simulating traffic in a physical roadway system in accordance with one embodiment.

With reference now to FIG. 3, there is illustrated a high level logical flowchart of an exemplary process of simulating traffic in a physical roadway system in accordance with one embodiment. The process begins at block 300 and thereafter proceeds to block 302, which depicts the establishment and configuration of a roadway system model 214 representing physical roadway system 100.

As discussed above, a segment 110 is the base unit of physical roadway system 100 over which traffic is modeled, measured and managed. Accordingly, at block 302, one or more data structures defining the locations, intersections and attributes of the segments 110 of the roadways 102, 104, 106, and 108 comprising physical roadway system 100 are established in roadway system model 214. The data structures can be established manually via data input into hardware processing unit 204 and/or through automated processing of electronic mapping data obtained, for example, from a governmental or commercial mapping data source, such as NAVTEQ, Inc. of Chicago, Ill. As will be appreciated, such automated processing can be subsequently modified, if desired, by manual data input.

In a typical embodiment, segments 110 can vary in length from ¼ mile to several miles long and can further contain one or more lanes 224 and one or more entry points and one or more exit points. In one preferred embodiment, boundaries of segments 110 are established such that each segment 110 is equipped with at least one traffic monitor 222. In an exemplary embodiment, the data structure recording information regarding a segment 110 can include some or all of the segment-related information summarized in Table I below.

TABLE I

| Segment attribute | Description |
|---|---|
| Segment route | Description of geographic path (which can be described in 2 or 3 dimensions) and intersection points of the segment |
| Segment length | Distance between boundaries of the segment measured, for example, in feet or meters |
| Segment lanes | Total number of travel lanes in the segment |
| Segment lane lengths | Individual lanes length(s) for lane(s) that do not extend the entire segment length |

TABLE I-continued

| Segment attribute | Description |
|---|---|
| Segment entrance volume | Number of vehicles entering the segment |
| Segment exit volume | Number of vehicles leaving the segment |
| Segment average speed | Average speed of vehicles in the segment |
| Segment entrance volume rate of change | Rate at which vehicles entering the segment are increasing or decreasing |
| Segment exit volume rate of change | Rate at which vehicles leaving the segment are increasing or decreasing |
| Segment entrance/exit differential | Difference between the rates at which vehicles are entering and leaving the segment |

With segments 110 defined, additional data structures can then be established within roadway system model 214 to define which segments 110 comprise which roadways 102, 104, 106, and 108. Each roadway 102, 104, 106, 108 represented within roadway system model 214 is preferably identified by a unique roadway name and a class indicating, among other things, at least a maximum legal speed of vehicle traffic on the roadway.

The establishment and configuration of roadway system model 214 at block 302 preferably further includes the implementation of other general settings roadway system model 214, including a travel distance schema. The travel distance schema sets the desired minimum distances between vehicles under given weather conditions and can be used to determine the volume of vehicles that a segment 110 of a roadway can support based on the real-time travel speeds and roadway conditions. The travel distance schema, which can be configured by default or by a system administrator, includes the parameters summarized below in Table II in one embodiment.

TABLE II

| Schema parameter | Description |
|---|---|
| Speed | Current average vehicle speed in a segment, as expressed, for example, in miles per hour or feet per second |
| Perception reaction distance | Distance vehicle travels at given speed until driver can react to need to brake |
| Dry braking distance | Estimate of distance for vehicle of average size and weight at a specific speed on a dry roadway with zero grade to come to a stop once brakes are applied. Stopping distances can be adjusted based on roadway grade or other considerations. |
| Wet braking distance | Estimate of distance for vehicle of average size and weight at a specific speed on a wet roadway with zero grade to come to a stop once brakes are applied. Again, stopping distance can be adjusted based on roadway grade or other considerations. |
| Dry stopping distance | Estimate of total stopping distance for vehicle of average size and weight at a specific speed on a dry roadway with zero grade, and thus, the minimum desired following distance between vehicles traveling at the specific speed under such conditions. Computed as the sum of perception reaction distance and dry braking distance. |
| Wet stopping distance | Estimate of total stopping distance for vehicle of average size and weight at a specific speed on a wet roadway with zero grade, and thus, the minimum desired following distance between vehicles traveling at the specific speed under such conditions. Computed as the sum of perception reaction distance and wet braking distance. |

An exemplary travel distance schema is given in Table III, below.

TABLE III

| Speed (mph) | Speed (fps) | Perception reaction distance | Dry braking distance | Wet braking distance | Dry stopping distance | Wet stopping distance |
|---|---|---|---|---|---|---|
| 20 | 29 | 44 | 19 | 24 | 63 | 68 |
| 30 | 44 | 66 | 43 | 55 | 109 | 121 |
| 40 | 59 | 88 | 76 | 97 | 164 | 185 |
| 50 | 73 | 110 | 119 | 152 | 229 | 262 |
| 55 | 81 | 121 | 144 | 183 | 265 | 304 |
| 60 | 88 | 132 | 171 | 218 | 303 | 350 |
| 65 | 95 | 143 | 201 | 256 | 344 | 399 |
| 70 | 103 | 154 | 233 | 297 | 387 | 451 |
| 75 | 110 | 165 | 268 | 341 | 433 | 506 |

The travel distance schema can, of course, include other parameters, such as whether the time of travel is during the daytime or nighttime.

Still referring to FIG. 3, following block 302 the process proceeds to block 304, which depicts simulator 212 executing multiple simulation runs of roadway system model 214 under a variety of traffic and weather conditions to determine default maximum (and optionally minimum) travel speeds for the roadways 102, 104, 106 and 108 in physical roadway system 100. In addition, simulator 212 determines the interrelationship of the traffic speeds and volumes between the segments 110 comprising the roadways 102, 104, 106 and 108 in physical roadway system 100. Simulator 212 stores simulation results 218 of these simulation runs in data storage 206 for subsequent reference in the real-time management of physical roadway system 100 by roadway system manager 216, as discussed further below. Following block 304, the process ends at block 306.

Figure 4:
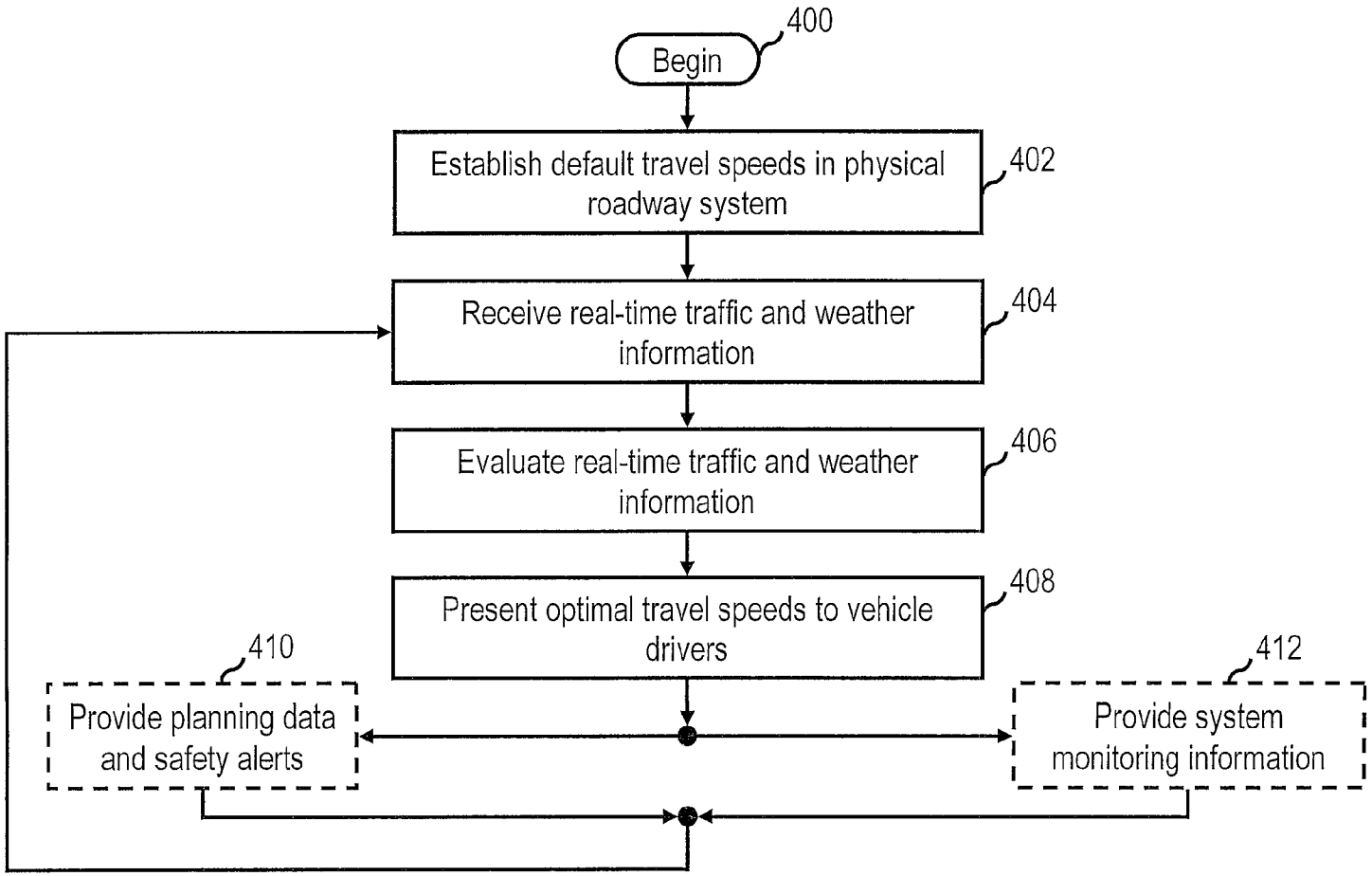
FIG. 4 is a high level logical flowchart of an exemplary process of applying intelligent roadway management to a physical roadway system in accordance with one embodiment.

Referring now to FIG. 4, there is depicted a high level logical flowchart of an exemplary process of applying intelligent roadway management in accordance with one embodiment. The process begins at block 400 and thereafter proceeds to block 402, which depicts roadway system manager 216 establishing the default travel speeds for one or more of roadways 102, 104, 106 and 108 in physical roadway system 100 based upon simulation results 218. The establishment of the default travel speeds at block 402 can include, for example, presenting an output from hardware processing unit 204 on a display device (not illustrated) or on a hardcopy printout indicating default travel speeds to be presented on fixed speed limit signage of one or more of roadways 102, 104, 106 and 108. In addition, roadway system manager 216 may transmit one or more speed advisory commands 230 to cause presentation of one or more advisory speeds on variable speed advisory signs 232 within physical roadway system 100.

Next, as illustrated at block 404, roadway system manager 216 receives via communication network(s) 220 real-time traffic information from traffic monitors 222 in the segments 110 of physical roadway system 110, as well as real-time weather information for the individual segments 110 of physical roadway system 110. In response to receipt of the real-time traffic and weather information, roadway system manager 216 evaluates the real-time traffic and weather information to identify segments 110 that are congested or may potentially become congested. In addition to the real-time traffic and weather information, roadway system manager 216 may also consider during the evaluation historical (i.e., previously observed) traffic congestion patterns, presence of emergency conditions or vehicles in a roadway segment 110, roadway maintenance or temporary lane closures, and simulation results 218. In the evaluation, roadway system manager 216 determines congestion or potential congestion in a particular segment 110 not only based upon traffic and weather information related to that particular segment 110, but also based upon traffic and weather information related to upstream and downstream segments 110 of the same roadway and/or intersecting roadways.

For example, consider an embodiment in which a portion of roadway 102 includes seven segments 110*a*-100*g* that are each 1000 ft in length and that the maximum speed limit of that portion of roadway 102 is 55 mph. Under dry conditions, the travel distance schema summarized in Table II gives a stopping distance of 265 ft for a vehicle is traveling 55 mph or 81 fps. If traffic is to have enough room to stop in the event of slowing traffic ahead, the commonly employed "2 second" rule suggests 81 fps×2 seconds or 162 ft of travel distance between adjacent vehicles. Thus, at a traffic speed of 55 mph, each of segments 110*a*-110*g* has a safe vehicle volume of (1000 ft×2 lanes)/162 ft or up to 12.3 vehicles.

Consequently, if real-time traffic information reported by traffic monitors 222 indicates that the difference between the segment entrance volume and segment exit volume of any of segments 110*a*-100*g* rises to 13 or more at any point in time, roadway system manager 216 preferably computes a reduced traffic advisory speed in that segment 110 to allow for the increased volume of vehicles. For example, if the real-time traffic information provided by traffic monitors 222 indicate that segment 110*g* has a current vehicle volume of 16, then roadway system manager 216 determines the minimum safe traveling distance between vehicles as 2000 ft/16 or 125 ft. According to the travel distance schema summarized in Table III, for a driver to be able to stop in 2 seconds in 125 feet, vehicles in segment 110*g* should travel at no more than 57 fps or 41 mph. Taking this computation a step further, roadway system manager 216 can adjust the advised travel speed of traffic in upstream segments 110*a*-110*f* to reduce congestion in segment 110*g*. Thus, although roadway system manager 216 can command reduction in the advised traffic speed for congested segment 110*g*, such adjustment may be too late to positively affect the driving conditions experienced by vehicles in segment 110*g*. Consequently, roadway system manager 216 preferably reduces the advised or optimal travel speed for segment 110*f* and/or other upstream segments 110*a*-110*e*, so that vehicles enter congested segment 110*g* at a slower rate. In one embodiment, roadway system manager 216 sequentially reduces advised travel speeds in segment 110*f*, then 110*e*, and then 110*d*, etc. if the traffic volume of segment 110*g* does not decrease toward the safe vehicle volume of 12.3.

Although the example given above illustrates the management of a physical roadway system 100 based upon traffic volumes in segments 110, roadway system manager 216 may alternatively or additionally implement intelligent traffic management based at least in part upon the segment entrance volume rate of change, segment exit volume rate of change and/or segment entrance/exit differential of segments 110. For a given segment 110, the entrance/exit differential can vary between −1 to 1, with a value of −1 indicating that vehicles are leaving the segment 110 and no vehicles are entering, a value of 0 indicating that vehicles are entering and leaving the segment 110 at the same rate, and a value of 1 indicating that vehicles are entering the segment 110 but are not leaving (e.g., a traffic accident in the segment 110 has blocked all traffic lanes).

Still referring to FIG. 4, based upon the evaluation performed at block 406, roadway system manager 216 issues one or more speed advisory commands 230 from hardware processing unit 204 via communication network(s) 220. As discussed above with reference to FIG. 2, a speed advisory command 230 cause a variable speed advisory sign 232 receiving the speed advisory command 230 to display the one or more advised speeds indicated by the command for viewing by drivers of vehicles. Roadway system manager 216 may optionally further control timing of traffic signal lights, manage opening, closure and occupancy requirement of high occupancy vehicle (HOV) lanes, or perform other management of physical roadway system 100.

Figure 5:
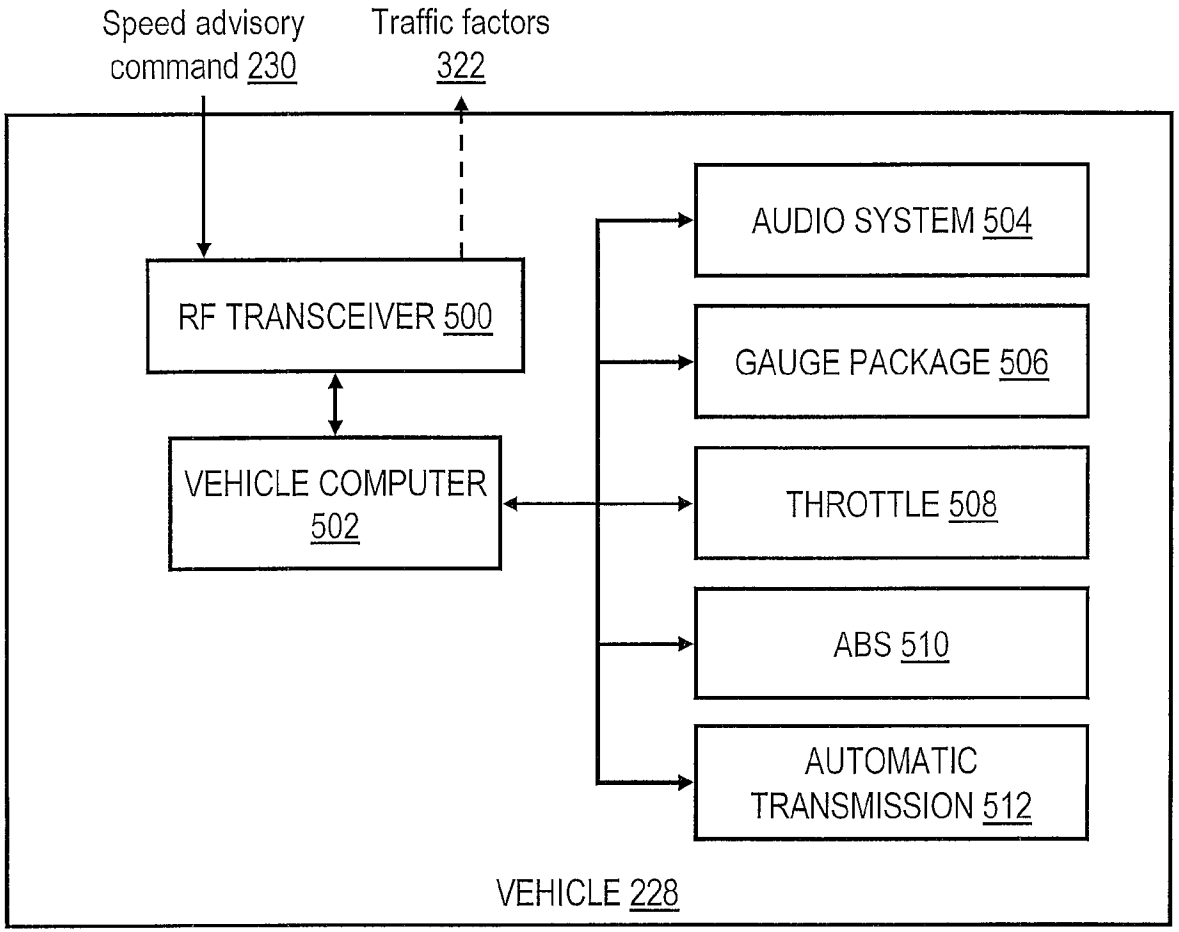
FIG. 5 is a high level block diagram of a vehicle including a vehicle computer in accordance with one embodiment.

As indicated in FIG. 5, speed advisory command 230 can also be wirelessly transmitted via communication network(s) 220 directly to one or more vehicles 228 traveling in one or more segments 110 of physical roadway system 110. As shown, a speed advisory command 230 is received by a radio frequency transceiver 500 in vehicle 228, which passes speed advisory command 230 to the vehicle computer 502 for processing. In response to receipt of a speed advisory command 230, vehicle computer 502 may present one or more advisory speeds indicated by the speed advisory command 230 to the driver via audio system 504 and/or gauge package 506. Alternatively or additionally, vehicle computer 502 may directly control throttle 508, anti-lock braking system (ABS) 510 and/or automatic transmission 512 to regulate the speed of vehicle 228 in accordance with an advised or optimal speed specified by speed advisory command 230. Vehicle computer 502 may optionally condition implementation of direct regulation of the speed of vehicle 228 in accordance with the speed advisory command 230 upon approval of the driver, for example, by a voice command received via audio system 504 or entry of an input via a control in gauge package 506.

In an alternative embodiment, vehicle computer 502 may be implemented as a non-integral component of vehicle 228. In such embodiments, vehicle computer 502 presents at least one advisory speed indicated by speed advisory command 230 to the driver, either audibly or visually, but in some cases may not be capable of direct regulation of the speed of vehicle 228 in accordance with the speed advisory command 230.

Referring again to FIG. 4, roadway system manager 216 may optionally provide additional management functionality for IRMS 200, as shown at blocks 410-412. Block 410 depicts roadway system manager 216 providing an alert (e.g., via a display or printed report) of the location(s) of severe or sudden traffic congestion to personnel in central office 202, which alert may indicate occurrence of an accident and/or a need to dispatch highway safety personnel to the location of the congestion. Roadway system manager 216 may additionally report to personnel in central office 202 (e.g., via a display or printed report) traffic planning data containing observed traffic patterns over time of various roadways in physical roadway system 100, which can be utilized to schedule construction repairs, plan future roadway enhancements, etc.

Block 412 depicts roadway system manager 216 providing a report of system monitoring information (e.g., via a display or printed report) to personnel in central office 202 identifying the functioning and non-functioning devices (e.g., traffic monitors 222, weather information source 226 or variable speed advisory signs 232) within IRMS 200. Should roadway system manager 216 detect a failure in one of the devices, roadway system manager 216 preferably activates a backup device, if available. Further, roadway system manager 216 may notify personnel in central office 202 (e.g., via a display or printed report) to dispatch a work crew to repair or replace the failed device. In the event of the failure of one or more devices for which no replacement is readily available, roadway system manager 216 can utilize simulation data, historical traffic data, and/or real-time traffic information from one or more neighboring segments 110 to interpolate proper driving speeds in the segment 110 containing the failed device(s).

As has been described, in some embodiments, a computer system receives, from devices distributed in a plurality of roadway segments of a physical roadway system, real-time traffic information individually describing vehicular traffic in each the plurality of roadway segments. The computer system determines from the real-time traffic information an advised speed for a particular roadway segment among the plurality of roadway segments. The computer system transmits, via a communication network, a speed advisory command specifying the advised speed to a device in the particular roadway segment for presentation.

While the present invention has been particularly shown as described with reference to one or more preferred embodiments, it will be understood by those skilled in the art that various changes in form and detail may be made therein without departing from the spirit and scope of the invention. While various embodiments have been particularly shown as described with reference to a preferred embodiment, it will be understood by those skilled in the art that various changes in form and detail may be made therein without departing from the spirit and scope of the claims. For example, although aspects have been described with respect to a computer system executing program code that directs the functions of the present invention, it should be understood that present invention may alternatively be implemented as a program product including a storage medium storing program code that can be processed by a data processing system.

What is claimed is:

1. A method of vehicular traffic management, comprising:

a computer system receiving, form devices distributed in a plurality of roadway segments of a physical roadway system including multiple intersecting roadways, real-time traffic information individually describing vehicular traffic in each of the plurality of roadway segments;

prior to the receiving, simulating traffic flow in the physical roadway system under a variety of traffic and weather conditions utilizing a simulation model of the physical roadway system and storing simulation results obtained by the simulating, wherein the simulation results include interrelationships of traffic speeds and volumes between roadway segments disposed in different ones of the multiple intersecting roadways;

the computer system determining from the real-time traffic information and the stored simulation results an advised speed for a particular roadway segment in a particular roadway among the multiple intersecting roadways, wherein the determining includes determining the advised speed for the particular roadway segment based on real-time traffic information from at least one other roadway segment in another of the multiple intersecting roadways and the interrelationships from the simulation results;

the computer system modifying a vehicle occupancy requirement of a high occupancy vehicle (HOV) lane spanning one or more of the plurality of roadway segments based on the real-time traffic information and the stored simulation results; and the computer system transmitting, via a communication network, a speed advisory command specifying the advised speed to a device in the particular roadway segment for presentation.

2. The method of claim 1, wherein said determining comprises determining the advised speed based upon the real-time traffic information and real-time weather information for the particular segment.

3. The method of claim 1, wherein said transmitting comprises transmitting the speed advisory command to a variable speed advisory sign in the particular roadway segment.

4. The method of claim 1, wherein said transmitting comprises transmitting the speed advisory command to a vehicle in the particular roadway segment.

5. The method of claim 4, and further comprising:

in response to the speed advisory command, a vehicle computer in the vehicle controlling one or more systems of the vehicle to cause the vehicle to approach the advised speed.

6. The method of claim 1, wherein:

the method further comprises:

prior to the receiving, recording historical traffic information observed in the physical roadway system; and determining the advised speed for the particular roadway segment comprises determining the advised speed from the real-time traffic information, the stored simulation results, and the recorded historical traffic information.

7. The method of claim 1, wherein:

the method further comprises defining a travel distance schema to be applied during simulation to simulated traffic in the simulation model, wherein the travel distance schema specifies minimum safe travel distances between vehicles for a plurality of traffic conditions; and simulating traffic flow includes applying the travel distance schema to simulation traffic in the simulation model.

8. The method of claim 1, wherein:

the real-time traffic information includes identifying a plurality of different vehicle types within the vehicular traffic; and determining the advised speed for the particular roadway segment comprises determining the advised speed based at least in part on the plurality of different vehicle types within the vehicular traffic.

9. The method of claim 1, wherein the determining comprises determining the advised speed for the particular roadway segment from real-time traffic information in another upstream roadway segment among the plurality of roadway segments.

10. The method of claim 1, wherein:

the real-time traffic information for each of the plurality of roadway segments includes a rate of change of vehicles transitioning between that roadway segment and an adjacent roadway segment; and determining the advised speed for the particular roadway segment comprises determining the advised speed based at least in part on the rates of change of vehicles transitioning between roadway segments among the plurality of roadway segments.

11. The method of claim 1, wherein:

the method further comprises defining a travel distance schema to be applied during simulation to simulated traffic in the simulation model, wherein the travel distance schema specifies minimum safe travel distances between vehicles for a plurality of traffic conditions;

simulating traffic flow includes applying the travel distance schema to simulation traffic in the simulation model;

the method further comprises:

prior to the receiving, recording historical traffic information observed in the physical roadway system;

determining the advised speed for the particular roadway segment comprises determining the advised speed from the real-time traffic information, the stored simulation results, and the recorded historical traffic information;

the real-time traffic information includes identifying a plurality of different vehicle types within the vehicular traffic; and determining the advised speed for the particular roadway segment comprises determining the advised speed based at least in part on the plurality of different vehicle types within the vehicular traffic.

12. The method of claim 1, and further comprising the computer system determining and controlling timing of traffic signal lights in the physical roadway system based on the real-time traffic information and the stored simulation results.

13. The method of claim 1, and further comprising the computer system modifying a number of available lanes in one or more of the plurality of roadway segments based on the real-time traffic information and the stored simulation results.

14. The method of claim 1, wherein determining the advised speed includes determining the advised speed based in part on the time of day.

15. The method of claim 1, and further comprising the computer system transmitting multiple additional speed advisory commands that sequentially modify advised speeds in immediately adjacent roadway segments upstream of the particular roadway segment until a desired real-time traffic metric is observed in the particular roadway segment.

16. The method of claim 15, wherein the desired real-time traffic metric is a traffic volume.

17. A program product for vehicular traffic management, the program product comprising:

a data storage device; and program code stored within the data storage device, wherein the program code includes:

a simulator that when processed by a computer system causes the computer system to simulate traffic flow in a physical roadway system including multiple intersecting roadways under a variety of traffic and weather conditions utilizing a simulation model of the physical roadway system and to store simulation results obtained by the simulating, wherein the simulation results include interrelationships of traffic speeds and volumes between roadway segments disposed in different ones of the multiple intersecting roadways;

a roadway system manager that, when processed by the computer system, causes the computer system to:

receive, from devices distributed in a plurality of roadway segments of the physical roadway system, real-time traffic information individually describing vehicular traffic in each of the plurality of roadway segments;

determine from the real-time traffic information and the stored simulation results an advised speed for a particular roadway segment in a particular roadway among the multiple intersecting roadways, wherein the advised speed for the particular roadway segment is determined based on real-time traffic information from at least one other roadway segment in another of the multiple intersecting roadways and the interrelationships form the simulation results;

modify a vehicle occupancy requirement of a high occupancy vehicle (HOV) lane spanning one or more of the plurality of roadway segments based on the real-time traffic information and the stored simulation results; and transmit, via a communication network, a speed advisory command specifying the advised speed to a device in the particular roadway segment for presentation.

18. The program product of claim 17, wherein program code causes the computer system to determine the advised speed based upon the real-time traffic information and real-time weather information for the particular segment.

19. The program product of claim 17, wherein program code causes the computer system to transmit the speed advisory command to a variable speed advisory sign in the particular roadway segment.

20. The program product of claim 17, wherein program code causes the computer system to transmit the speed advisory command to a vehicle in the particular roadway segment.

21. A data processing system for vehicular traffic management, the data processing system comprising:

a hardware processing unit;

a data storage medium coupled to the hardware processing unit; and program code stored within the data storage medium, wherein the program code includes:

a simulator that when processed by the hardware processing unit causes the hardware processing unit to simulate traffic flow in the physical roadway system including multiple intersecting roadways under a variety of traffic and weather conditions utilizing a simulation model of the physical roadway system and to store simulation results obtained by the simulating, wherein the simulation results include interrelationships of traffic speeds and volumes between roadway segments disposed in different ones of the multiple intersecting roadways;

a roadway system manager that, when processed by the hardware processing unit, causes the hardware processing unit to:

receive, from devices distributed in a plurality of roadway segments of the physical roadway system, real-time traffic information individually describing vehicular traffic in each of the plurality of roadway segments;

determine from the real-time traffic information and the stored simulation results an advised speed for a particular roadway segment in a particular roadway among the multiple intersecting roadways, wherein the advised speed is determined for the particular roadway segment based on real-time traffic information from at least one other roadway segment in another of the multiple intersecting roadways and the interrelationships from the simulation results;

modify a vehicle occupancy requirement of a high occupancy vehicle (HOV) lane spanning one or more of the plurality of roadway segments based on the real-time traffic information and the stored simulation results; and transmit, via a communication network, a speed advisory command specifying the advised speed to a device in the particular roadway segment for presentation.

22. The data processing system of claim 21, wherein program code causes the hardware processing unit to determine the advised speed based upon the real-time traffic information and real-time weather information for the particular segment.

23. The data processing system of claim 21, wherein program code causes the hardware processing unit to transmit the speed advisory command to a variable speed advisory sign in the particular roadway segment.

24. The data processing system of claim 21, wherein program code causes the hardware processing unit to transmit the speed advisory command to a vehicle in the particular roadway segment.

* * * * *